US006358078B1

(12) United States Patent
Crippa

(10) Patent No.: US 6,358,078 B1
(45) Date of Patent: Mar. 19, 2002

(54) ANTI-DECOUPLING MECHANISM FOR A THREADED COUPLING CONNECTOR

(75) Inventor: Valerio Crippa, Rho (IT)

(73) Assignee: Veam S.r.l., Milan (IT)

( * ) Notice: Subject to any disclaimer, the term of this patent is extended or adjusted under 35 U.S.C. 154(b) by 0 days.

(21) Appl. No.: 09/849,248

(22) Filed: May 7, 2001

(51) Int. Cl.[7] ..... H01R 4/38
(52) U.S. Cl. ..... 439/321; 439/283
(58) Field of Search ..... 439/320, 321, 439/323, 304, 306, 307, 308, 309, 310, 311, 587, 589

(56) References Cited

U.S. PATENT DOCUMENTS 3,786,396 A * 1/1974 Kemmer et al. ..... 439/321
3,963,297 A * 6/1976 Panek et al. ..... 43/204
4,857,007 A * 8/1989 Michaels et al. ..... 439/283
5,035,640 A * 7/1991 Drogo ..... 439/321
5,435,760 A * 7/1995 Miklos ..... 439/321
6,086,400 A * 7/2000 Fowler ..... 439/321

* cited by examiner

*Primary Examiner*—Tulsidas Patel
(74) *Attorney, Agent, or Firm*—Lowe Hauptman Gilman & Berner, LLP

(57) ABSTRACT

The present invention is directed to an electrical connector having a resilient gasket between mating components. This resilient gasket serves a dual purpose. The resilient gasket provides both a seal and also when compressed, loads the electrical connector in a manner that resists vibration.

17 Claims, 3 Drawing Sheets

ANTI-DECOUPLING MECHANISM FOR A THREADED COUPLING CONNECTOR

FIELD OF THE INVENTION

The present invention relates generally to electrical connectors, and more particularly, to an anti-coupling mechanism for a threaded coupling connector.

BACKGROUND OF THE INVENTION

Threaded electrical coupling connectors are known. One type of threaded coupling connector is a ratchet type threaded coupling connector. In this type of connector a detent is provided in the coupling mechanism such that an audible click is evident when proper coupling is accomplished. A ratchet action threaded coupling connector is specified in series III of MIL-C-38999. As specified, in the mil-specification, complete coupling shall be accomplished by approximately 360° clockwise rotation of the coupling nut and shell to provide metal-to-metal bottoming. Also, as specified in the mil-specification, an anti-decoupling device shall be provided to maintain complete coupling. The described connector utilizes three internal toothed beams attached to the interior of the coupling nut which ratchet against external teeth located on the exterior of the plug shell.

As depicted in FIGS. 1A–1C, an example of a prior art electrical connector assembly 10 which conforms to MIL-C-38999 is depicted. As depicted in FIG. 1A, the electrical connector assembly 10 includes a plug 20 and a receptacle 30. The plug 20 has a shoulder 22 against which a shoulder 32 of the receptacle 30 is brought into contact with to provide the body-to-body or metal-to-metal contact required by MIL-C-38999. The plug 20 has one or more grooves 28. Each groove 28 receives a spring 44 (see FIG. 1C). The spring 44 has a V-shape and is snapped into a corresponding groove 34 in the receptacle 30 as the plug 20 is rotated 360° relative to the receptacle 30. The combination of spring 44 and groove 34 provide the snap action. The principle by which the anti-decoupling mechanism is provided on the electrical connector illustrated in FIGS. 1A–1C is that there is a spring ratchet (including spring 44 and groove 34), which provides a resistance that the rotation threaded coupling nut sufficient to prevent uncoupling during specific dynamic tests. MIL-C-38999 specifies coupling torques for the various shell sizes in terms of a maximum engagement and disengagement as well as a minimum disengagement torque.

This MIL-C-38999 type of electrical connector is often subject to vibration. Even though the electrical connector 10 has an anti-decoupling device, the electrical connector 10 will decouple when subject to such vibration. This problem has been noted by the present inventors using a threaded coupling connector according to the MIL-C-38999 specification when the threaded coupling nut de-couples under vibration. Accordingly, a need exists for an electrical connector that is more resistant to vibration than prior art connectors.

SUMMARY OF THE INVENTION

It is, therefore, an object of the present invention to provide an electrical connector which is more resistant to vibration than prior art connectors.

It is another object of the present invention to provide an electrical connector with a resilient gasket between mating parts which is compressed and which pre-loads components of the electrical connector to resist vibration.

The present invention is directed to an electrical connector having an o-ring between mating components. This o-ring serves a dual purpose. The o-ring provides both a seal and when compressed, loads the electrical connector in a manner that resists vibration.

These and other objects of the present invention are achieved by a connector. The connector includes a plug shell having external teeth and a shoulder. The connector includes a coupling nut having internal teeth, a shoulder and a thread portion. The connector includes a receptacle shell having an end surface and a threaded portion. A resilient gasket is positioned adjacent said shoulder of the coupling nut. When the coupling nut threaded portion and the receptacle shell threaded portion are engaged, the plug shell external teeth and the coupling nut internal teeth are engaged and the resilient gasket is sandwiched between the coupling nut shoulder and the receptacle shell end surface.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 2:
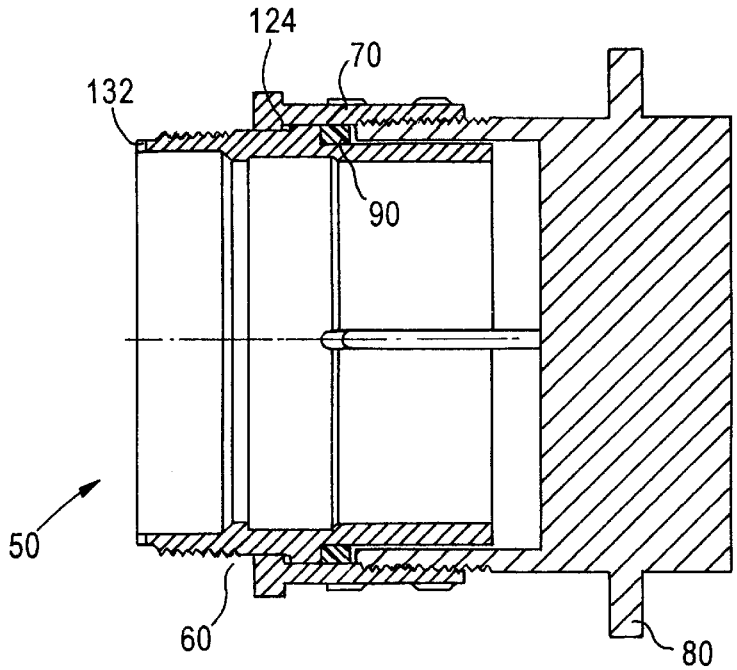
FIG. 2 is a side elevational view in cross-section depicting the electrical connector according to the present invention in a coupled position.

Referring first to FIG. 2, an electrical connector, generally indicated at 50, is depicted in a horizontal position. The electrical connector can be fabricated from either plastic or metal. It should be understood that the electrical connector 50, according to the present invention, is usable in any orientation. The electrical connector 50 includes a plug shell 60, a coupling nut 70 and a receptacle shell 80. As depicted in FIG. 2, the electrical connector 50 is illustrated in a coupled position. A resilient gasket 90 is located between the plug shell 60 and receptacle shell 80 and when the coupling nut 70 is tightened onto the receptacle shell 80, the resilient gasket 90 is resiliently deformed and provides a seal. The compressive stresses on the resilient gasket 90 resists vibrational forces which the electrical connector 50 may be subject to during operation thereby keeping the plug shell 60, the coupling nut 70 and the receptacle shell 80 together during vibration.

Figure 2A:
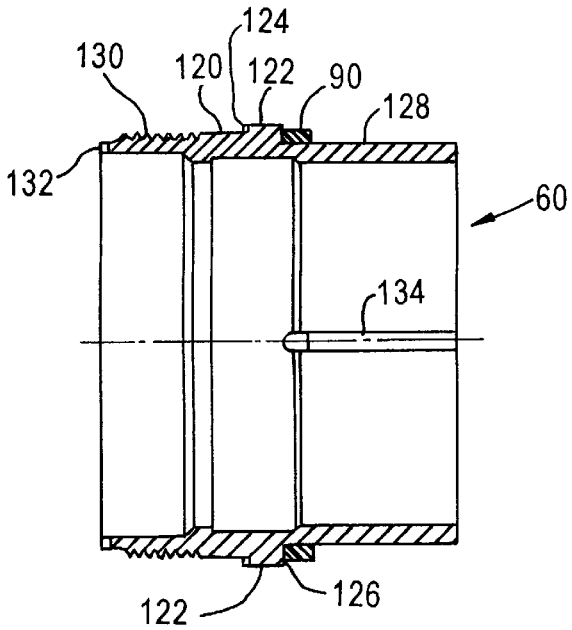
FIG. 2A is a cross-sectional side elevational view of the plug shell.
Figure 2B:
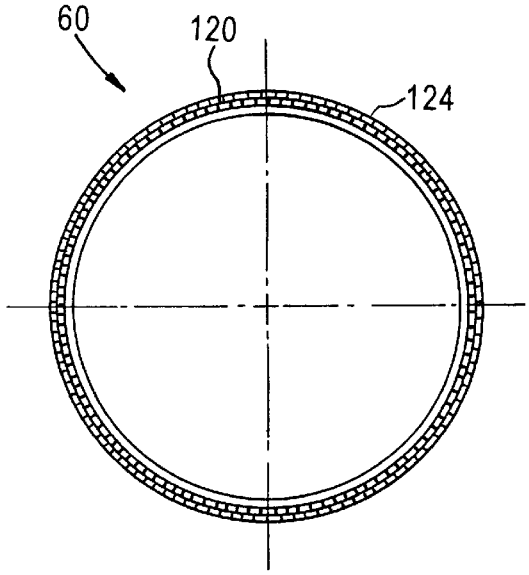
FIG. 2B is a left side elevational view of the plug shell of FIG. 2A.

Refer now to FIGS. 2A and 2B where the plug shell 60 is depicted. Plug shell 60 has a cylindrical body 120. A centrally located annular shoulder 122 extends outwardly from an outer surface of the body 120. A plurality of small approximately V-shaped teeth 124 are located on a longitudinal surface of the shoulder 122. An opposite surface 126 of the shoulder 122 is located on the resilient gasket 90.

Figure 1C:
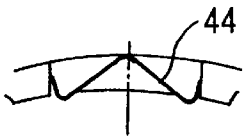
FIG. 1C (PRIOR ART)
FIG. 1C is a top plain view of a spring used in the spring ratchet of FIG. 1.
Figure 1B:
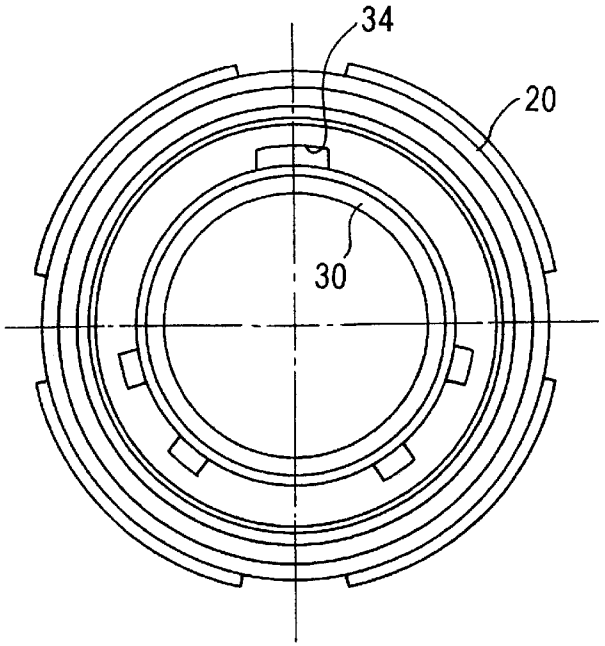
FIG. 1B (PRIOR ART)
FIG. 1B is a left elevational view of the electrical connector of FIG. 1.
Figure 1A:
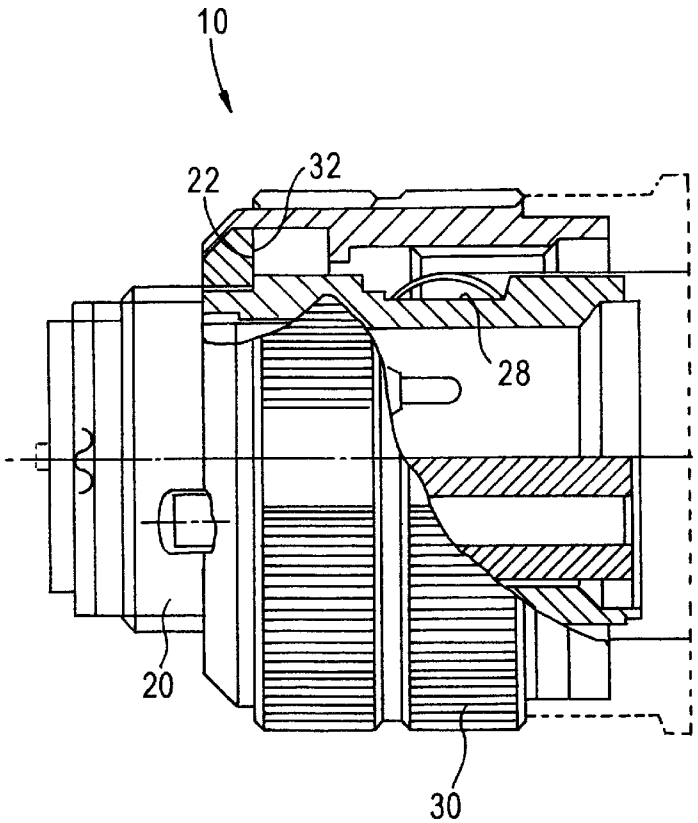
FIG. 1A (PRIOR ART)
FIG. 1A is a side elevational, partially in cross section, depicting an example of a prior art electrical connector that conforms to MIL-C-38999.

As depicted in FIGS. 1 and 2A, the resilient gasket 90 has a rectangular cross-section. Other shapes including a round gasket or o-ring can be used. A rearwardly extending cylindrical surface 128 extends from the shoulder 122 and terminates at a distal end of the plug shell 60. External threads 130 are formed on an opposite outer cylindrical portion of the plug shell body 60. A plurality of V-shaped teeth 132 are located on a distal end of the plug body 60. A longitudinal slot 134 extends from roughly the center of the plug shell body 60 to the surface 134 through the wall of the plug shell 60.

Figure 3B:
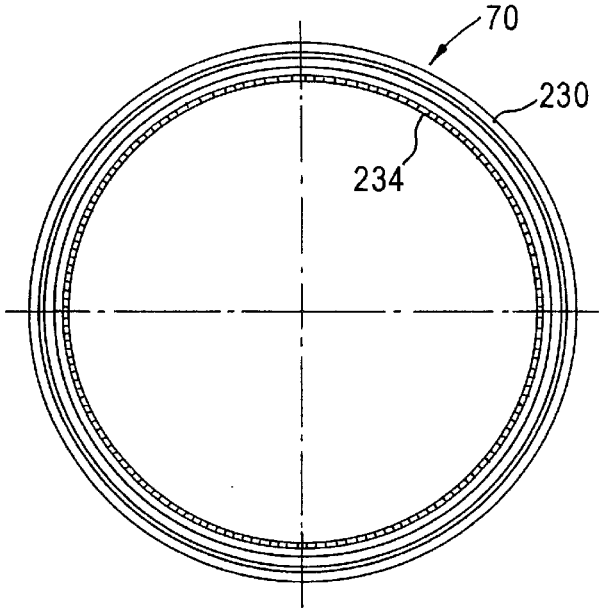
FIG. 3B is a top plan view of the plug shell of FIG. 2A.
Figure 3A:
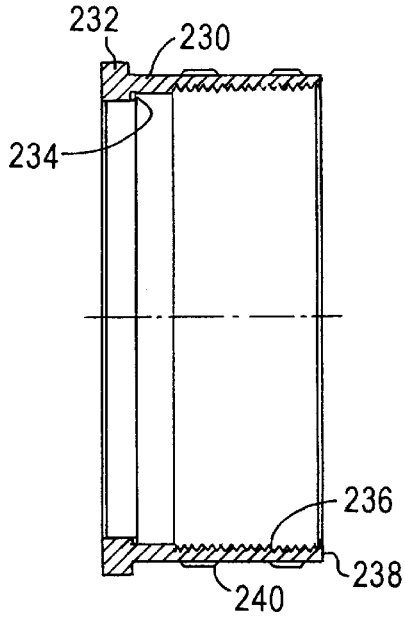
FIG. 3A is a side elevational view of the plug shell in FIG. 1.

The coupling nut 70 is depicted in FIGS. 3A and 3B. The coupling nut 70 has a cylindrical body 230. A shoulder 232 extends from one end thereof both radially outwardly and radially inwardly. The radially inwardly extending portion has a plurality of inwardly and longitudinally facing teeth 234 which are to be brought into engagement with teeth 124 of the plug shell 60. An internally threaded portion 236 extends inwardly from an edge 238. A gripping surface 240 is located on an outer surface of the coupling nut body 230.

Figure 4B:
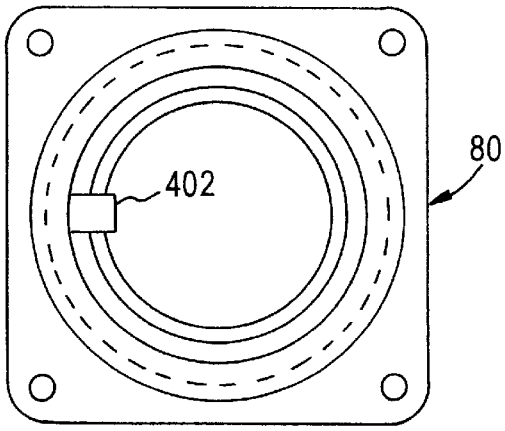
FIG. 4B is a top plan view of the coupling nut of FIG. 3A.
Figure 4A:
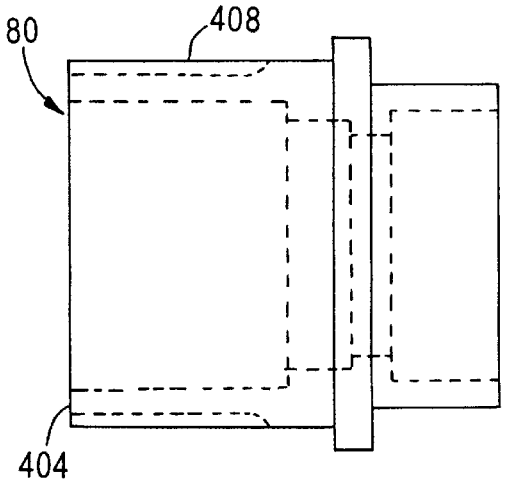
FIG. 4A is a side elevational view of the coupling nut of FIG. 1.

As depicted in FIG. 4A, the receptacle shell 80 includes a front cylindrical portion 408 having external threads 410 and a front edge 404. A longitudinally key 402 extends radially inwardly from an inner wall of the front cylindrical portion 408.

Referring back now to FIG. 2, the electrical connector is assembled as follows. First, the plug shell 60 is aligned with the receptacle shell 80 such that the key 402 is brought into alignment with the slot 134. The plug shell 60 is then moved in a longitudinal direction such that the resilient gasket 90 is brought into contact with surface 404. The threads 236 of the coupling nut 70 is then rotated until the threads 236 are fully engaged with the external threads 408 of the receptacle shell 80. Eventually the V-shaped teeth 234 engage the V-shaped teeth 124 until an audible noise is heard at such time the connector 50 is fully engaged.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A connector, comprising:

a plug shell having external teeth and a shoulder, said external teeth rotatable with said plug shell;

a coupling nut having internal teeth, a shoulder and a threaded portion, said internal teeth rotatable with said receptacle shell;

a receptacle shell having an end surface and a threaded portion; and a resilient gasket positioned adjacent said shoulder of said plug shell;

wherein when said coupling nut threaded portion and said receptacle shell threaded portion are engaged said plug shell external teeth and said coupling nut internal teeth are engaged and said resilient gasket is sandwiched between said plug shell shoulder and said receptacle shell end surface.

2. The connector of claim 1, wherein said coupling nut internal teeth and said plug shell internal teeth each have a V-shape and extend in opposite longitudinal directions.

3. The connector of claim 1, wherein said plug shell external teeth extend from said plug shell shoulder and wherein said coupling nut internal teeth extend from said coupling nut shoulder.

4. The connector of claim 1, wherein said resilient gasket is elastomeric.

5. The connector of claim 4, wherein said resilient gasket has a rectangular or round cross-section.

6. The connector of claim 1, wherein said plug shell and said receptacle shell do not make body-to-body contact when said plug shell and said receptacle shell are fully engaged.

7. The connector of claim 1, wherein said plug shell has a slot and said receptacle shell has a key to be received in said slot.

8. The connector of claim 1, wherein said plug shell teeth and said coupling nut teeth are sufficiently shallow that when said teeth engage said plug shell and said coupling nut can rotate in opposite directions.

9. The connector of claim 1, wherein said plug shell and said receptacle shell are not in metal-to-metal contact.

10. A connector, comprising:

a plug shell having external teeth and a shoulder, said external teeth rotatable with said plug shell;

a coupling nut having internal teeth, a shoulder and a threaded portion, said internal teeth rotatable with said receptacle shell;

a receptacle shell having an end surface and a threaded portion; and a resilient gasket positioned adjacent said shoulder of said plug shell;

wherein when said coupling nut threaded portion and said receptacle shell threaded portion are engaged said plug shell external teeth and said coupling nut internal teeth are engaged and said resilient gasket is sandwiched between said plug shell shoulder and said receptacle shell end surface;

wherein said plug shell and said receptacle shell are not in metal-to-metal contact.

11. The connector of claim 10, wherein said coupling nut internal teeth and said plug shell internal teeth each have a V-shape and extend in opposite longitudinal directions.

12. The connector of claim 10, wherein said plug shell external teeth extend from said plug shell shoulder and wherein said coupling nut internal teeth extend from said coupling nut shoulder.

13. The connector of claim 10, wherein said resilient gasket is elastomeric.

14. The connector of claim 10, wherein said resilient gasket has a rectangular or round cross-section.

15. The connector of claim 10, wherein said plug shell and said receptacle shell do not make body-to-body contact when said plug shell and said receptacle shell are fully engaged.

16. The connector of claim 10, wherein said plug shell has a slot and said receptacle shell has a key to be received in said slot.

17. The connector of claim 10, wherein said plug shell teeth and said coupling nut teeth are sufficiently shallow that when said teeth engage said plug shell and said coupling nut can rotate in opposite directions.

* * * * *